United States Patent [19]

McAffrey

[11] Patent Number: 4,574,409

[45] Date of Patent: Mar. 11, 1986

[54] BATH SEAT

[76] Inventor: E. Maye McAffrey, 1101 Loftin Dr., Midwest City, Okla. 73130

[21] Appl. No.: 728,474

[22] Filed: Apr. 29, 1985

[51] Int. Cl.[4] ..... A47K 3/12

[52] U.S. Cl. ..... 4/579

[58] Field of Search ..... 4/579, 578, 575, 604, 4/605, 571, 573, 447, 444, 483; D23/52

[56] References Cited

U.S. PATENT DOCUMENTS

| | | | |
|---|---|---|---|
| 2,985,889 | 5/1961 | Fain et al. | 4/579 |
| 3,040,335 | 6/1962 | Gellmann | 4/579 |
| 3,458,876 | 8/1969 | Struthers | 4/579 |
| 3,584,320 | 6/1971 | Locke | 4/578 |
| 4,034,425 | 6/1977 | Van Riemsdyck | 4/579 |
| 4,123,808 | 11/1978 | Guarrera | 4/447 |
| 4,166,297 | 9/1979 | Saleeby | 4/578 |
| 4,253,203 | 3/1981 | Thomas | 4/604 |
| 4,287,619 | 9/1981 | Brewer et al. | 4/483 |
| 4,520,515 | 6/1985 | Hatala | 4/573 |
| 4,521,926 | 6/1985 | Kuether | 4/579 |

FOREIGN PATENT DOCUMENTS

| | | | |
|---|---|---|---|
| 19089 | 8/1904 | Austria | 4/579 |
| 1600875 | 10/1981 | United Kingdom | 4/579 |
| 2119241 | 11/1983 | United Kingdom | 4/579 |

*Primary Examiner*—Stephen Marcus
*Assistant Examiner*—Leo Peters
*Attorney, Agent, or Firm*—Dunlap, Codding & Peterson

[57] ABSTRACT

A bath seat adapted to be placed in a bath tub so an individual can sit on the bath seat for bathing including a seat having a seating area, a central exposure opening and a front exposure opening, the central exposure opening being positioned so the buttocks area of an individual is exposed and the front exposure opening being positioned so the genital area of an individual is exposed when an individual is sitting on the bath seat to facilitate the bathing of such individual.

10 Claims, 4 Drawing Figures

BATH SEAT

BACKGROUND OF THE INVENTION

Field of the Invention

The present invention relates generally to bath seats and, more particularly, but not by way of limitation, to bath seats adapted to cooperate in exposing certain areas of an individual to facilitate bathing.

DESCRIPTION OF THE PREFERRED EMBODIMENT

Figure 1:
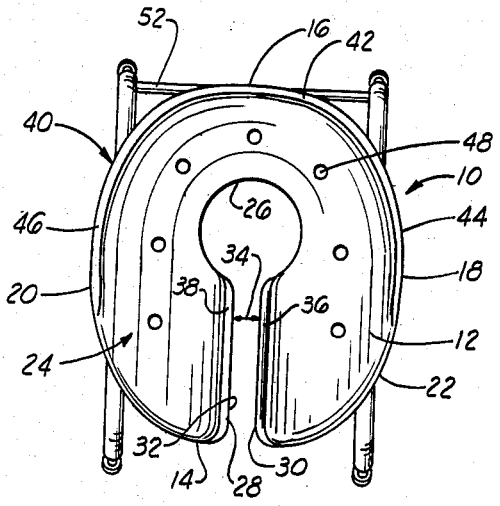
FIG. 1 is a top elevational view of a bath seat which is constructed in accordance with the present invention.
Figure 2:
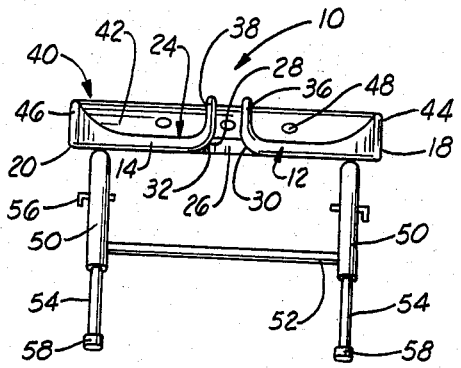
FIG. 2 is a front elevational view of the bath seat of FIG. 1.
Figure 3:
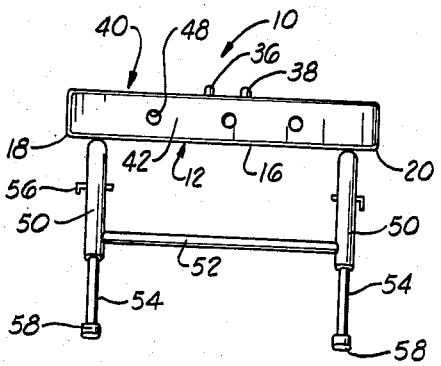
FIG. 3 is a rear or back elevational view of the bath seat of FIGS. 1 and 2.
Figure 4:
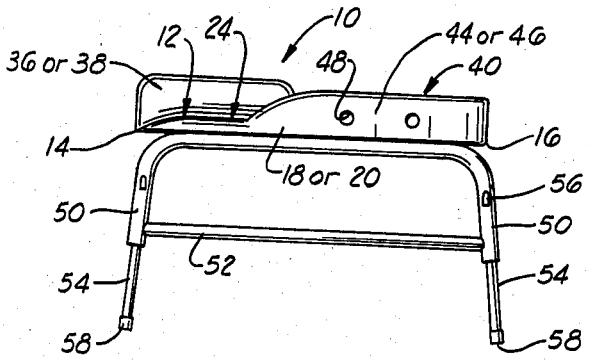
FIG. 4 is a typical side elevational view of the bath seat of FIGS. 1, 2 and 3.

Shown in FIG. 1 and designated by the general reference numeral 10 is a bath seat which is constructed in accordance with the present invention. In general, the bath seat 10 includes a seat 12 having a front 14 (shown in FIGS. 1, 2 and 4), a back 16 (shown in FIGS. 1, 3 and 4), a left side 18 (the left side 18 being designated from the user's viewpoint), a right side 20 (the right side 20 being designated from the user's viewpoint), an outer peripheral surface 22 (shown in FIG. 1) and an upper surface 24 (shown in FIGS. 1, 2 and 4) which is shaped and adapted to form a seating area. The seating area 24 has a generally somewhat round or elliptical shape which is adapted to accommodate an individual who sits generally on the seating area during the use of the bath seat 10.

A central exposure opening 26 (shown in FIGS. 1 and 2) is formed through a central portion of the seating area 24. A front exposure opening 28 (shown in FIGS. 1 and 2) is formed through the seating area 24. More particularly, the front exposure opening 28 intersects the front 14 of the seat 12 and extends a distance through the seat 12 (the seating area 24) intersecting the central exposure opening 26.

The front exposure opening 28 forms a first edge 30 (shown in FIGS. 1 and 2) and a second edge 32 (shown in FIGS. 1 and 2) in the seat 12. The first and the second edges 30 and 32 each intersect the front 14 of the seat 12 and extend a distance through the seat 12 generally toward the back 16 of the seat 12 intersecting the central exposure opening 26. The first edge 30 is generally parallel with the second edge 32 and the first edge 30 is spaced a distance 34 (shown in FIG. 1) from the second edge 32.

A first lip 36 is connected to the seating area 24 generally adjacent the first edge 30, the first lip 36 being more particularly formed as an integral portion of the seat 12 in the embodiment of the invention shown in the drawings. The first lip 36 extends a distance generally along the entire length of the first edge 30 and the first lip 36 extends a distance in an upwardly direction from the seating area 24.

A second lip 38 is connected to the seating area generally adjacent the second edge 32, the second lip 38 being more particularly formed as an integral portion of the seat 12 in the embodiment of the invention shown in the drawings. The second lip 38 extends a distance generally along the entire length of the second edge 32 and the second lip 38 extends a distance in an upwardly direction from the seating area 24.

A support 40 is connected to the seat 12 generally adjacent the outer peripheral surface 22 and the support 40 extends a distance in a generally upwardly direction from the seating area 24. The support 40, more particularly, includes a back portion 42 (shown in FIGS. 1, 2 and 3) which extends generally along the back 16 of the seat 12 and is positioned and adapted to provide some support for the adjacent back portion of the individual when the individual is seated on the seating area 24. The support 40 also includes a left side portion 44 which extends generally along the left side 18 of the seat 12 and which is positioned and adapted to provide some support for the adjacent left side portion of an individual when an individual is seated on the seating area 24. The support 40 also includes a right side portion 46 which extends generally along the right side 20 of the seat 12 and which is positioned and adapted to provide some support for the adjacent right side portion of an individual when the individual is seated on the seating area 24. In the embodiment of the invention shown in the drawing, the support 40 is formed as an integral portion of the seat 12 so that the seat 12 is an integral, one piece formed element.

A plurality of drain openings 48 are formed through the seat 12 (only some of the drain openings 48 being specifically designated by reference numeral in the drawings). Some of the drain openings are formed through the seating area 24 and some of the drain openings are formed through the support 40. The drain openings 48 are positioned and adapted to facilitate the drainage of water during the operation of the bath seat 10.

Legs 50 are connected to the seat 12 for supporting the seat 12 a predetermined distance above the bathtub floor when the bath seat 10 is placed in a bathtub. As shown in the drawings, the bath seat 10, more particularly, includes four legs 50 with one end of each of the legs 50 being connected to the seat 12 and each of the legs 50 extending a distance from the seat 12 terminating with a supporting end.

The bath seat 10 also includes a plurality of braces 52 (three braces 52 being shown in the drawings). One of the braces 52 is connected between the rear two legs 50, one of the braces 52 is connected between the left two legs 50 and one of the braces 52 is connected between the right two legs 50. The braces 52 cooperate to provide structural integrity to the legs 50 and cooperate with the legs 50 to support the seat 12 in an elevated position.

In one preferred embodiment as shown in the drawings, each of the legs 50 includes a telescoping portion 54. Each telescoping portion 54 is slidingly or telescopingly disposed in one of the legs 50 so that each telescoping portion 54 may be telescopingly moved into or withdrawn from one of the legs 50. A post 56 extends through openings (not shown in the drawings) in the legs 50 and the telescoping portion 54 for securing each telescoping portion 54 in a predetermined position within one of the legs 50.

The telescoping portions 54 thus may be moved into or withdrawn from the legs 50 and the cooperating posts 56 secure the telescoping portions 54 in the legs 50 for adjusting the length of each leg 50 so the distance the seat 12 is supported above the bathtub floor is adjustable to varying heights.

A rubber cap 58 is secured to the supporting end of each of the legs 50 (more particularly secured to the supporting end of the telescoping portion 54 of each of the legs 50). The rubber caps 58 engage the bathtub floor when the bath seat 10 is in operation to reduce slippage between the supporting ends of the legs 50 and the bathtub floor.

In operation, the bath seat 10 is placed on a bathtub floor of a bathtub with the rubber caps 58 on the supporting ends of the legs 50 engaging the bathtub floor to reduce slippage between the bath seat 10 and the bathtub floor. The individual then sits on the seating area 24 with the individual's right leg being disposed generally on the right side 20 of the seat 12 and the individual's left leg being disposed generally on the left side 18 of the seat 12, the individual's legs extending over the front 14 of the seat 12. In this position, the first lip 36 engages the adjacent portions of the inside thigh of the left leg of the individual and the second lip 38 engages the adjacent portions of the thigh on the right leg of the individual so the lips 36 and 38 cooperate to hold the individual's legs in a spread or spaced apart position thereby exposing through the central exposure opening 26 the individual's genital area. When the individual is seated on the seating surface 24, the central exposure opening 26 exposes the buttocks area of the individual. Thus, the bath seat 10 with the central exposure opening 26 and the front exposure opening 28 particularly is adapted to expose the individual's buttocks and genital area to facilitate the bathing of such individual. Further, when the individual is seated on the seating surface 24, the back portion 42 of the support 40 engages adjacent portions of the individual's back, the left side portion 44 of the support 40 engages adjacent portions of the individual's left side and the right side portion 46 of the support 40 engages adjacent portions of the individual's right side so the support 40 cooperates to support the individual in a seated position on the seating surface 24 during bathing.

It should be noted that, although the present invention has been described and claimed particularly referring to the bath seat 10 setting on the bathtub floor of a bathtub, the terms "bathtub" and "bathtub floor" as used herein specifically refer to a bathing area and such terms are not intended to limit the present invention only for use in what specifically might be referred to as a bathtub. Further, although the bath seat 10 has been disclosed herein as having legs 50 for supporting the seat 12, the seat 12 also may be supported by rails which attach to the sides of a bathtub which may be preferred in some embodiments.

Changes may be made to the various parts, elements, components and assemblies described herein without departing from the spirit and the scope of the invention as defined in the following claims.

What is claimed is:

1. A bath seat adapted to be placed in a bathtub with a bathtub floor so an individual can sit on the bath seat for bathing; comprising:

a seat having an outer peripheral surface and an upper surface forming a seating area adapted so an individual can sit on such seating area, and having a central exposure opening extending through a central portion of the seating area and having a front exposure opening extending through the outer peripheral surface, and the front exposure opening extending a distance through a portion of the seating area and intersecting the central exposure opening, the central exposure opening being positioned so the buttocks area of an individual is exposed when an individual is seated on the seating area and the front exposure opening positioned so the genital area of an individual is exposed when the individual is seated on the seating area, the front exposure opening forming a first edge and a second edge in the seat, the first edge being spaced a distance from the second edge and the first and the second edges each having a portion intersecting the outer peripheral surface of the seat and a portion intersecting the central exposure opening;

a first lip connected to the seating area generally adjacent the first edge, the first lip extending a distance generally along the first edge and extending a distance generally upwardly from the seating area;

a second lip connected to the seating area generally adjacent the second edge, the second lip extending a distance generally along the second edge and extending a distance generally upwardly from the seating area, the first lip being positioned and shaped to engage a portion of the inside thigh of the right leg of an individual when seated on the seating area and the second lip being positioned and shaped to engage a portion of the inside thigh of the left leg of an individual when seated on the seating area and the first and the second lips cooperating to hold the individual's legs in a separated, spaced apart position to facilitate the exposure of the individual's genital area; and means for supporting the seat in the bathtub so the seating area is elevated a distance above the bathtub floor.

2. The bath seat of claim 1 defined further to include:

a support connected to the seat generally adjacent the outer peripheral surface and extending a distance generally upwardly from the seating area.

3. The bath seat of claim 2 wherein the seat has a front, a back, a right side and a left side and wherein the support is defined further as having a portion extending generally along the back of the seat and being positioned and adapted to provide some support for the adjacent back portion of the individual when the individual is seated on the seating area.

4. The bath seat of claim 3 wherein the support is defined further as having a portion extending generally along the right side of the seat and being positioned and adapted to provide some support for the adjacent right side portion of the individual when the individual is seated on the seating area, and wherein the support includes a portion extending generally along the left side of the seat and being positioned and adapted to provide some support for the adjacent left side portion of the individual when the individual is seated on the seating area.

5. The bath seat of claim 4 defined further to include drain openings extending through the support, such drain openings being adapted and positioned to facilitate the drainage of water.

6. The bath seat of claim 1 defined further to include drain openings extending through the seat, such drain openings being spaced and adapted to facilitate the drainage of water.

7. The bath seat of claim 1 wherein the seat includes a front, a back, a right side and a left side and wherein the front exposure opening intersects the front side and extends a distance generally toward the back side.

8. The bath seat of claim 1 wherein the means for supporting the seat is defined further to include a plurality of legs, each leg having one end connected to the seat and each leg extending a distance from the seat terminating with a supporting end.

9. The bath seat of claim 8 defined further to include:

means on the supporting end of each leg for engaging the bathtub floor adapted to reduce slippage between the supporting ends of the legs and the bathtub floor.

10. The bath seat of claim 8 wherein the legs are defined further to include:

means for adjusting the length of each leg so that the distance the seat is supported above the bathtub floor is adjustable to varying heights.

* * * * *